United States Patent [19]

Weirich et al.

[11] Patent Number: 4,613,257

[45] Date of Patent: Sep. 23, 1986

[54] HYDRAULIC CONTROL ARRANGEMENT

[75] Inventors: Walter Weirich, Dortmund; Michael Dettmers, Kamen, both of Fed. Rep. of Germany

[73] Assignee: Gewerkschaft Eisenhütte Westfalia, Fed. Rep. of Germany

[21] Appl. No.: 563,859

[22] Filed: Dec. 21, 1983

[30] Foreign Application Priority Data

Dec. 22, 1982 [DE] Fed. Rep. of Germany ..... 3247367
May 21, 1983 [DE] Fed. Rep. of Germany ..... 3318641

[51] Int. Cl.[4] ..... E21D 15/14; E21D 23/00; E21D 23/16; F15B 11/20

[52] U.S. Cl. ..... 405/302; 405/293; 405/299; 91/189 R; 91/520

[58] Field of Search ..... 405/293, 294, 298–302; 91/189, 189 R, 520; 60/579

[56] References Cited

U.S. PATENT DOCUMENTS

| | | | |
|---|---|---|---|
| 3,030,930 | 4/1962 | Gratzmuller | 91/189 X |
| 3,426,649 | 2/1969 | Koppers | 91/189 X |
| 4,192,222 | 3/1980 | Dits | 91/189 X |
| 4,192,482 | 3/1980 | Goldman et al. | 91/189 R X |
| 4,234,130 | 11/1980 | Trott et al. | 91/189 R X |
| 4,343,226 | 8/1982 | de Almeida | 91/520 X |
| 4,427,321 | 1/1984 | Weirich et al. | 405/302 X |
| 4,440,522 | 4/1984 | Dettmers et al. | 405/302 X |

*Primary Examiner*—Cornelius J. Husar
*Assistant Examiner*—Nancy J. Stodola
*Attorney, Agent, or Firm*—Sughrue, Mion, Zinn, Macpeak & Seas

[57] ABSTRACT

A hydraulic control arrangement comprises a first hydraulic ram, a second hydraulic ram, and a hydraulic control circuit associated with the first and second hydraulic rams. Each of the hydraulic rams has a cylinder, a piston reciprocable within the cylinder, and a piston rod fixed to the piston. Each of the hydraulic rams has a cylindrical working chamber and an annular working chamber positioned on opposite sides of its piston. The piston rod of each hydraulic ram constitutes the cylinder of a respective metering ram, a respective metering piston being reciprocable within the cylinder of each metering ram to define a metering chamber therewithin. The hydraulic control circuit includes a line, which interconnects the two metering chambers, and a hydraulic valve positioned in a hydraulic fluid supply line leading to the cylindrical working chamber of the second hydraulic ram. The metering piston of the second hydraulic ram controls the hydraulic valve, thereby controlling the flow of hydraulic fluid to the cylindrical working chamber of the second hydraulic ram.

25 Claims, 2 Drawing Figures

HYDRAULIC CONTROL ARRANGEMENT

BACKGROUND TO THE INVENTION

This invention relates to a hydraulic control arrangement for a roof support unit of a longwall mineral mining installation having a conveyor and a plurality of roof support units positioned side-by-side along the goaf side of the conveyor, and in particular to hydraulic control means for controlling the advance of roof bar extensions of the roof bars of the roof support units.

The roof bar extensions of such an installation are advanced towards the face being won by hydraulic rams associated with the corresponding roof bars. The roof bar extensions support the roof of the mineral mining working in the critical region adjacent to the face. It is important, therefore, to advance the roof bar extensions as soon as possible after the conveyor has been advanced following a winning run of the plough (or other winning machine) along the face side of the conveyor. Known systems for advancing the roof bar extensions incorporate either manual control means or automatic control means.

A known hydraulic control arrangement is effective to advance the roof bar extension of a roof support unit by the same distance as that through which the advance ram of that unit advances the associated conveyor section. The hydraulic ram which advances the roof bar extension is actuated by the movement of the advance ram which advances said conveyor section. The resulting synchronisation of the roof bar extension ram and the advance ram enables the roof of the working to be supported reliably, at all times, even in the critical region adjacent to the face. The roof bar extension ram is controlled by a metering ram having a metering chamber which communicates with the working chamber of the advance ram that diminishes in volume as the associated conveyor section is advanced. Thus, the hydraulic fluid displaced from this working chamber of the advance ram passes into the metering chamber. Then, by pressurising the metering piston of the metering ram, a metered amount of hydraulic fluid is forced out of the metering chamber into the appropriate working chamber of the roof bar extension ram, so that the roof bar extension is advanced towards the mineral face (see British Pat. No. 2 068 050).

A form of hydraulic control arrangement of this type has the metering ram formed within the advance ram. In this case, the metering chamber is formed within the piston rod (which is hollow) of the advance ram, the metering piston being guided in the hollow piston rod and being braced against the end wall of the cylinder. When the conveyor is advanced, the metering piston forces pressurised hydraulic fluid out of the metering chamber and into the appropriate working chamber of the roof bar extension ram, so that the roof bar extension is advanced towards the mineral face in synchronism with the advance of the conveyor. The metering chamber is arranged to have a cross-section which corresponds to that of said working chamber of the roof bar extension, so that the roof bar extension is advanced by the same distance as the conveyor (See DE-OS No. 3 217 822).

The aim of the invention is to provide an improved hydraulic control arrangement of this type. In particular, the hydraulic control arrangement should achieve reliable synchronous control without the need for matching the cross-sectional area of the roof bar extension ram absolutely to the cross-sectional area of the metering ram.

SUMMARY OF THE INVENTION

The present invention provides a hydraulic control arrangement comprising a first hydraulic ram, a second hydraulic ram, and a hydraulic control circuit associated with the first and second hydraulic rams, each of the hydraulic rams having a cylinder, a piston reciprocable within the cylinder, and a piston rod fixed to the piston, and each of the hydraulic rams having a cylindrical working chamber and an annular working chamber positioned on opposite sides of its piston, wherein the piston rod of each hydraulic ram constitutes the cylinder of a respective metering ram, a respective metering piston being reciprocable within the cylinder of each metering ram to define a metering chamber therewithin, wherein the hydraulic control circuit includes a line, which interconnects the two metering chambers, and a hydraulic valve positioned in a hydraulic fluid supply line leading to one of the working chambers of the second hydraulic ram, and wherein the metering piston of the second hydraulic ram controls the hydraulic valve, thereby controlling the flow of hydraulic fluid to said one working chamber of the second hydraulic ram.

Thus, the metering piston of the first hydraulic ram is used to load the metering piston of the second hydraulic ram, which, in turn, opens the hydraulic valve through which the second hydraulic ram is charged with pressurised hydraulic fluid during extension. The hydraulic valve is kept open by the metering piston of the second hydraulic ram for a period which depends upon the working stroke of the metering piston of the first hydraulic ram. Consequently, the working stroke of the second hydraulic ram is dependent upon the working stroke of the first hydraulic ram, so that synchronised control takes place.

Advantageously, the arrangement further comprises a high-pressure hydraulic fluid supply line and a hydraulic return line, the high-pressure line and the return line being connectible to the working chambers of the first and second hydraulic rams. Preferably, the metering piston of the first hydraulic ram extends through the piston of that ram, and is fixed to the internal end wall of the cylinder of that ram.

In a preferred embodiment, the hydraulic valve is positioned in the end wall of the cylinder of the second hydraulic ram that defines part of said one working chamber. Conveniently, the hydraulic valve is a mechanically-actuated, spring-loaded, non-return valve. In order to achieve synchronised control with working strokes of the same length, the metering chambers may have the same cross-sectional area.

Advantageously, the metering piston of the second hydraulic ram extends through the piston of the second hydraulic ram, said metering piston being movable relative to both the piston rod and the cylinder of the second hydraulic ram. The metering piston may control the hydraulic valve indirectly by means of an actuating member. Preferably, the actuating member is a rod which is slidably mounted in a bore in said end wall of the cylinder of the second hydraulic ram.

The line which interconnects the two metering chambers may be connected to the return line by a hydraulic line which incorporates a non-return valve. In this way, the metering chamber of the first hydraulic ram is filled with hydraulic fluid during extension of that ram. It is further recommended that the metering chambers are protected by pressure-relief valves.

In a preferred embodiment, a first hydraulic control valve is arranged in the hydraulic fluid supply line upstream of the hydraulic valve, the first hydraulic control valve being arranged to control the flow of hydraulic fluid from the high-pressure line along the hydraulic fluid supply line to the hydraulic valve, and being opened and closed in dependence upon the pressure of the hydraulic fluid in the metering chamber of the second hydraulic ram. This valve prevents unrequired extension of the second hydraulic ram if the hydraulic valve were to fail. Thus, the provision of the first hydraulic control valve further increases the functional reliability of the hydraulic control arrangement, and ensures that, when the second hydraulic ram is the advance ram of a roof bar extension, the roof bar extension cannot be extended so far that collision with a winning machine can occur. Advantageously, the first hydraulic control valve is a hydraulically-operated valve which has a hydraulic control line connected to the line which interconnects the two metering chambers. Thus, the first hydraulic control valve is opened only when the pressure of hydraulic fluid in the hydraulic system constituted by the interconnected metering chambers has reached a predetermined level.

Advantageously, a second hydraulic control valve is arranged in the hydraulic fluid supply line, the second hydraulic control valve being a mechanically-operated control valve, and being effective to open and close the hydraulic fluid supply line to the flow of hydraulic fluid from the high-pressure line.

Preferably, the arrangement further comprises a manually-actuated hydraulic control valve for controlling the extension and retraction of the second hydraulic ram. Advantageously, the manually-actuated hydraulic control valve controls the flow of hydraulic fluid between the high-pressure and return lines and hydraulic lines leading to the two working chambers of the second hydraulic ram. In this case, the arrangement may further comprise a control device for controlling the first hydraulic control valve. Conveniently, the control device includes a non-return valve which is connected to the line which interconnects the two metering chambers so that, when said non-return valve is open, the line interconnecting the two metering chambers (and hence the hydraulic control line associated with the first hydraulic control valve) is connected to the return line, whereby the first hydraulic control valve is closed to block the flow of hydraulic fluid from the high pressure line along the hydraulic fluid supply line. The control device may be provided with a manually-actuated switching member by means of which the control device is actuated, and the hydraulic lines connecting the working chambers of the second hydraulic ram to the manually-actuated hydraulic control valve may include respective hydraulically-operated, non-return valves.

There may be a plurality of second hydraulic rams, the metering chamber of each of which is connected to the metering chamber of the first hydraulic ram. Advantageously, the volume of the annular working chamber of the first hydraulic ram is at least equal to the volume of the annular working chamber of the second hydraulic ram(s).

In a preferred embodiment, the arrangement further comprises a third hydraulic ram, the third hydraulic ram having cylindrical and annular working chambers which are pressurisable in dependence upon the pressurisation of one of the working chambers of the first hydraulic ram.

Advantageously, the arrangement further comprises a low-pressure hydraulic fluid supply line, the cylindrical working chamber of the third hydraulic ram being connected to the low-pressure line via a hydraulic line which includes a hydraulically-actuated control valve, said control valve being provided with a hydraulic control line which is connected to the cylindrical working chamber of the first hydraulic ram. Conveniently, the cylindrical working chamber of the third hydraulic ram is connected to the high-pressure line via a hydraulic line containing a pilot-operated control valve. Preferably, the pilot-operated control valve is a 3/3-way control valve whose input side is connected to the high-pressure line and to the return line.

The invention also provides a roof support unit for a mineral mining installation, the roof support unit comprising a floor sill, a roof bar supported above the floor sill, a roof bar extension associated with the roof bar, and a hydraulic control arrangement as defined above, the first hydraulic ram of the hydraulic control arrangement being arranged to advance a conveyor section relative to the roof support unit, and the second hydraulic ram of the hydraulic control arrangement being arranged to advance the roof bar extension with respect to the roof bar.

Advantageously, the third hydraulic ram is arranged to brace the roof bar extension against the roof of a mine working.

Preferably, the second hydraulic control valve is arranged to close the hydraulic fluid supply line when the roof bar extension is inclined to the roof bar at a predetermined angle. This contributes to the functional reliability of the hydraulic control arrangement, since the automatic advance of the roof bar extension is immediately inhibited if, because of, for example, material breaking away from the roof, the roof bar extension asumes an angle of inclination at which there is a risk of collision with a winning machine moving along the mineral face.

The invention further provides a mineral mining installation comprising a conveyor, and a plurality of roof support units positioned side-by-side along the goaf side of the conveyor, wherein each of the roof support units is as defined above.

The invention also provides a hydraulic ram comprising a cylinder, a piston reciprocable within the cylinder, and a piston rod fixed to the piston, the hydraulic ram having a cylindrical working chamber and an annular working chamber positioned on opposite sides of the piston, and the piston rod constituting the cylinder of a metering ram, a metering piston being reciprocable within the cylinder of the metering ram to define a metering chamber therewithin, wherein a hydraulic valve is positioned in the end wall of the cylinder that defines part of the cylindrical working chamber, the hydraulic valve controlling the supply of pressurised hydraulic fluid to the cylindrical working chamber, and the hydraulic valve being actuated by movement of the metering piston towards said end wall.

BRIEF DESCRIPTION OF THE DRAWINGS

The invention will now be described in greater detail, by way of example, with reference to the accompanying drawings, in which.

DESCRIPTION OF PREFERRED EMBODIMENTS

Figure 1:
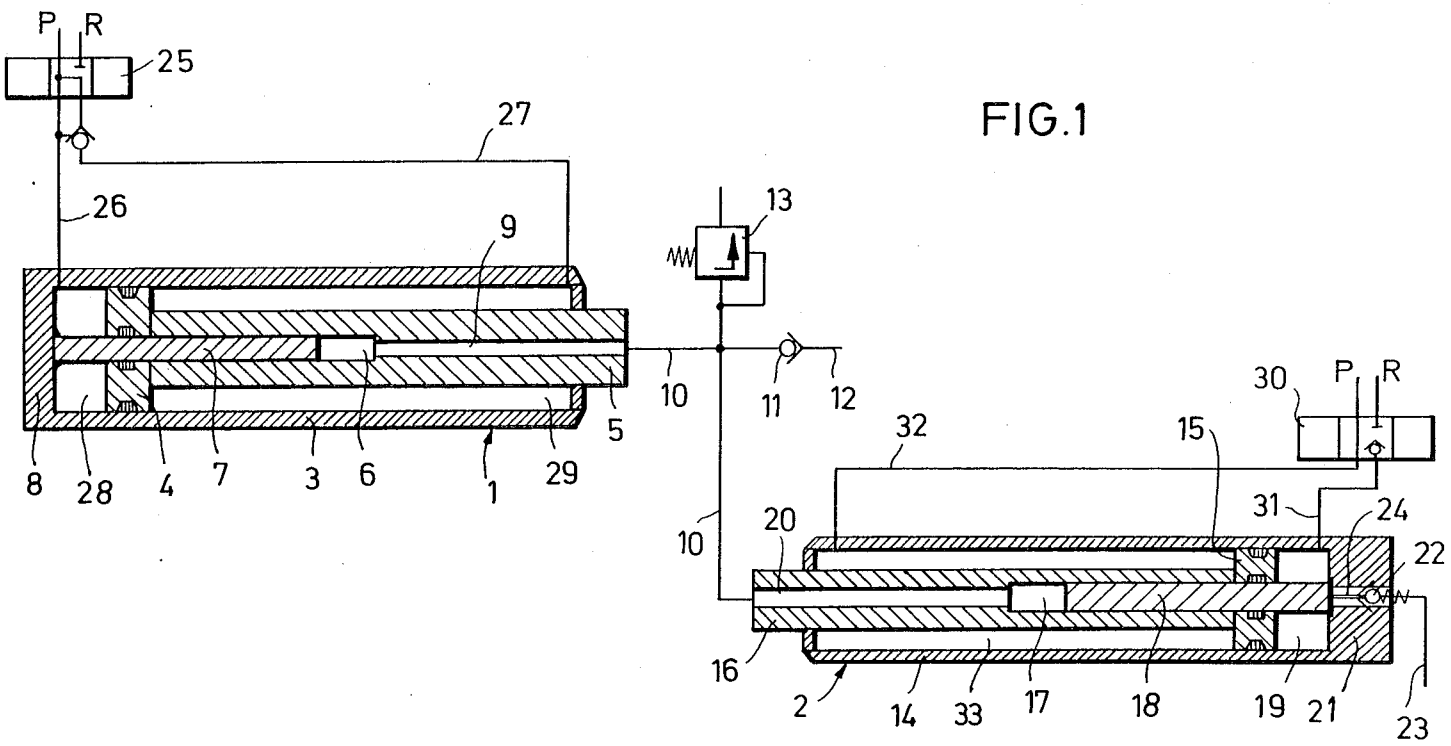
FIG. 1 is a schematic representation of the advance ram of a mine roof support unit, a ram for advancing an extension of a mine roof support unit roof bar, and a simplified hydraulic circuit diagram.

Referring to the drawings, FIG. 1 shows a hydraulic advance ram 1 of a mine roof support unit (not shown), and a hydraulic ram 2 which is used for advancing a forward extension (not shown) of the roof bar of that roof support unit. The forward extension is slidably supported by the roof bar, which in turn is supported above a floor sill by means of hydraulic props. The roof support unit is positioned side-by-side with other roof support units on the goaf side of a longwall conveyor (such as a scraper-chain conveyor) in a longwall mine working.

In the illustrated arrangement, the advance ram 1 forms part of a known type of advance mechanism which includes relay rods connected between the roof support unit and the conveyor. Retraction of the advance ram 1 advances the conveyor towards the face of the longwall working by way of the relay rods; and extension of the advance ram advances the roof support unit in a follow-up step, the conveyor being used as an abutment for the advance of the roof support unit.

The advance ram is constituted by a cylinder 3, a piston 4 which is slidably guided within the cylinder, and a piston rod 5 fixed to the piston. The piston rod 5 has an axially-extending bore, and so constitutes the cylinder of a metering ram. The metering ram has a metering piston 7, which acts within the bore of the piston rod 5 to define a metering chamber 6. The metering piston 7 extends through, and is sealed off from the piston 4. The metering piston 7 is fixed to the base 8 of the advance ram 1. The metering chamber 6 is connected to the free end of the piston rod 5 by an axially-extending bore 9. The bore 9 has a smaller diameter than the bore defining the metering chamber 6, and is connected to a hydraulic line 10. The line 10 is connected to a hydraulic return line 12 by way of a non-return valve 11. A pressure-relief valve 13 is also connected to the line 10.

The ram 2 is constituted by a cylinder 14, a piston 15 which is slidably guided within the cylinder, and a piston rod 16 which is connected to the roof bar extension. The piston rod 16 has an axially-extending bore, and so constitutes the cylinder of a metering ram. The metering ram has a metering piston 18 which acts within the bore of the piston rod 16 to define a metering chamber 17. The metering piston 18 extends through, and is sealed off from, the piston 15. The metering piston 18 passes through the cylindrical working chamber 19 of the ram 2 towards the base 21 of this ram. The metering chamber 17 is connected to the free end of the piston rod 16 by an axially-extending bore 20. The bore 20 has a smaller diameter than the bore defining the metering chamber 17, and is connected to the line 10. The metering chamber 6 of the advance ram 1 is, therefore, in continuous hydraulic communication with the metering chamber 17 of the ram 2, by way of the line 10.

A mechanically-actuated, spring-loaded, non-return valve 22 is arranged in a bore in the base 21 of the ram 2, the bore leading to the working chamber 19 of the ram 2. A hydraulic line 23 leads away from the mouth of this bore. The valve 22 has a closure member in the form of a ball. The valve 22 is normally held in the closed position by the pressure of hydraulic fluid in the line 23. In order to open the valve 22, its ball is lifted from its seat, in opposition to this pressure, by the piston rod 18 via a rod 24 (or other actuating member) which projects into the working chamber 19. Thus, the working chamber 19 of the ram 2 can be charged with hydraulic fluid from the line 23, so as to extend the ram 2, and so advance the roof bar extension towards the face.

The advance ram 1 is provided with a hydraulic control valve 25, which can be actuated either manually or automatically. The input side of the control valve 25 is connected to a hydraulic pressure line P and to a hydraulic return line R. The output side of the control valve 25 is connected to the cylindrical working chamber 28 and the annular working chamber 29 of the advance ram 1 by lines 26 and 27 respectively. A similar hydraulic control valve 30 is associated with the ram 2, the input side of the control valve 30 being connected to the pressure line P and the return line R; and the output side being connected, via respective lines 31 and 32, to the cylindrical working chamber 19 and the annular working chamber 33 of the ram 2.

In order to advance the longwall conveyor, the annular working chamber 29 of the advance ram 1 is charged with the pressurised hydraulic fluid, via the control valve 25, so that the piston 4 moves into the cylinder 3. As this happens, the metering piston 7 displaces a certain quantity of hydraulic fluid from the metering chamber 6 into the metering chamber 17 of the ram 2, and thus forces the metering piston 18 towards the base 21 of the ram 2. The metering piston 18 applies thrust to the rod 24 of the valve 22. This opens the valve 22 and establishes communication with the line 23. As a result, the piston 15, together with the piston rod 16, is moved out of the cylinder 14 to advance the roof bar extension towards the face. As the piston 15 moves out, the volume of the metering chamber 17 increases, so that the metering piston 18 moves away from the rod 24 of the valve 22. Consequently, the valve 22 closes again, under the pressure of the hydraulic fluid in the line 23. The metering chamber 17 of the ram 2 has a cross-section coresponding to that of the metering chamber 6 of the advance ram 1. The working stroke of the metering piston 18 is, therefore, equal to the working stroke of the metering piston 7. This ensures that, when the advance ram 1 is retracted (that is to say when the longwall conveyor is advanced), the metering piston 18 of the ram 2 executes the same working stroke as the metering piston 7.

The metering piston 18 thus holds the valve 22 in the open position over a distance of travel that coresponds to the retraction stroke of the advance ram 1. This ensures that the ram 2 executes the same working stroke as the advance ram 1.

In order to advance the roof support unit, in a follow-up step, after the longwall conveyor has been advanced, the cylindrical working chamber 28 of the advance ram 1 is charged with pressurised hydraulic fluid via the control valve 25, so tht the piston 4 moves out of the cylinder 3. As this happens, the metering chamber 6 is filled with pressurised hydraulic fluid from the return line 12, via the non-return valve 11 which is now open. The ram 2 is extended in a similar manner with the aid of its control valve 30. The pressure relief valve 13 is effective to bleed off excess pressure from both the metering chambers 6 and 17.

Figure 2:
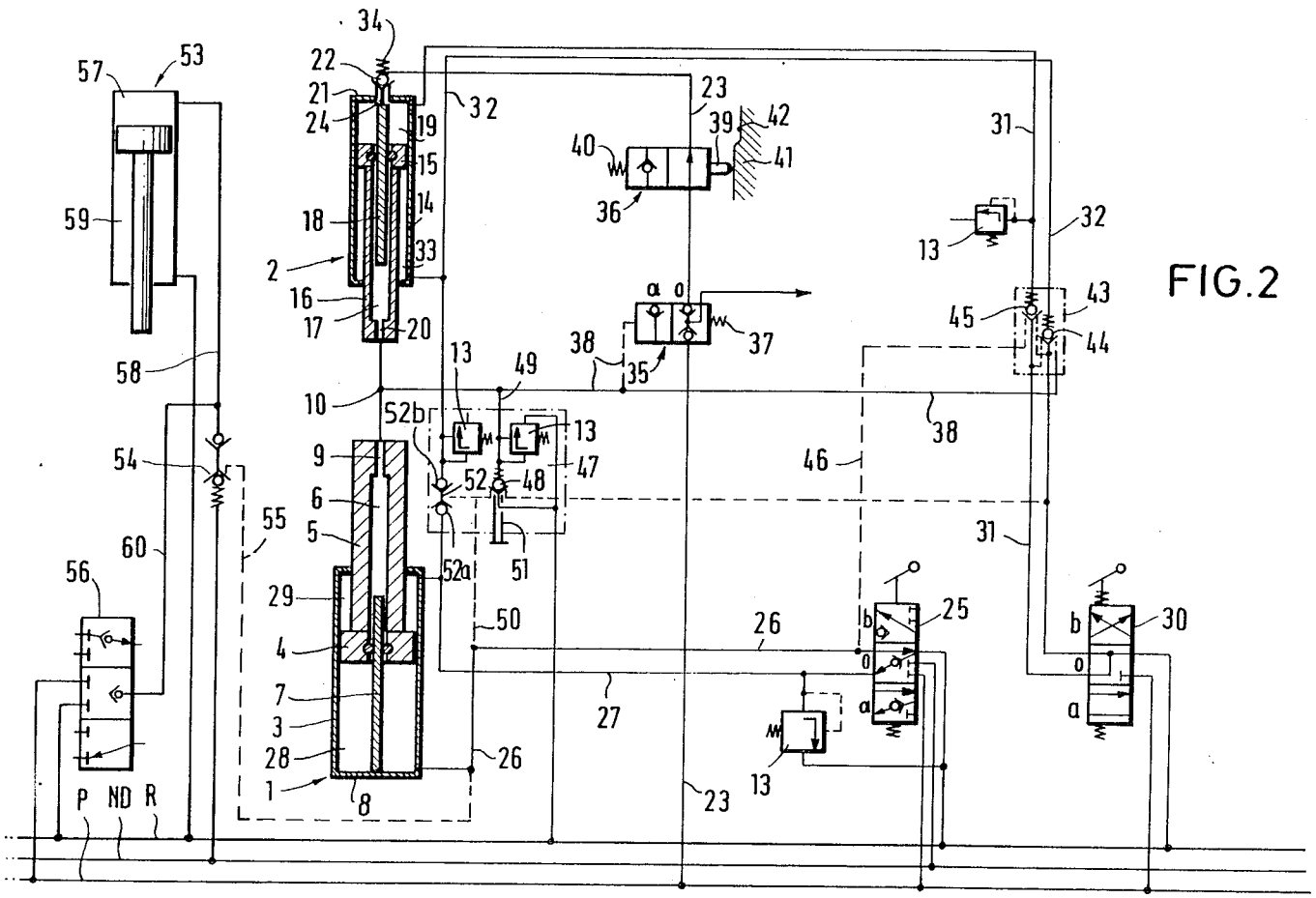
FIG. 2 is a view similar to FIG. 1, but showing a more advanced hydraulic circuit diagram.

The more advanced hydraulic circuit diagram shown in FIG. 2 represents a preferred form of hydraulic control means. The hydraulic circuit of FIG. 2 is basically a more complex version of the circuit of FIG. 1, so corresponding parts have been given the same reference symbols.

Referring now to FIG. 2, the input side of a multiway contol valve 25, which is a manually-operable control valve, is connected to a high-pressure line P, a return line R and a low-pressure line ND. The low-pressure line ND is used to retract the advance ram 1 in order to advance the conveyor, whereas the high-pressure line P is used to extend the advance ram in order to advance the roof support unit in a follow-up step. A manually-operable, multi-way control valve 30 is associated with the ram 2, the input side of the control valve 30 being connected only to the high-pressure line P and the return line R. The valve 22, which is fitted in the base 21 of the ram 2, is provided with a spring 34 which biasses the closure member (ball) against its valve seat. In order to open the valve 22, an actuating member (rod) 24, which projects into the working chamber 19 of the ram 2, is again provided, and this is actuated by the metering piston 18 of the ram 2. Control valves 35 and 36 are arranged in series in the line 23 connecting the valve 22 to the high-pressure line P. The control valve 35 is a hydraulically-operated control valve, which is normally closed (see FIG. 2) by the biassing force of a spring. In this position, (position o), the control valve 35 prevents the flow of pressurised hydraulic fluid along the line 23. The control valve 35 can be opened (to position a) by the pressure of hydraulic fluid in a control line 38. The control line 38 connects the control valve 35 to the line 10 which connects the metering chamber 6 of the advance ram 1 to the metering chamber 17 of the ram 2.

The control valve 36 is a mechanially-operated control valve, which is biassed towards a closed position by the force of a spring 40. The control valve 36 is normally held open by a plunger 39, so as to permit flow of pressurised hydraulic fluid along the line 23 (see FIG. 2). The plunger 39 is operated by a component 41 of the roof support unit. For example, the component 41 could be the goaf shield or the roof bar of the roof support unit. The arrangement is such that hydraulic fluid flows through the control valve 36 as long as the roof bar extension associated with the ram 2 does not exceed a predetermined angle of inclination relative to the floor of the mine working. If the roof bar extension did assume an excessive angle of inclination, there could arise the danger of a winning machine (such as a coal plough) colliding with the roof bar extension as it moved along the mineral face. When the angle of inclination of the roof bar extension exceeds the predetermined angle, the plunger 39 is arranged to contact a narrow cam portion 42 of the component 41. This releases the plunger 39, so that the control valve 36 is closed by the force of the spring 40. The control valve 36 then blocks the flow of hydraulic fluid along the line 23, and so prevents the extension of the ram 2, and the advance of the associated roof bar extension.

The control valve 25 is a 5/3-way valve having switching positions o, a and b. If the control valve 25 is switched from the illustrated position o into the position a, the annular working chamber 29 of the advance ram 1 is connected to the low-pressure line ND, and the cylindrical working chamber 28 of the advance ram is connected to the return line R. Consequently, the advance ram 1 is retracted, and the conveyor is thereby advanced towards the mineral face. As the advance ram 1 is retracted, pressurised hydraulic fluid is forced out of the metering chamber 6 and into the metering chamber 17 of the ram 2, via the line 10. This causes the metering piston 18 to move towards the rod 24 and, in so doing, opens the valve 22 against the biassing force of the spring 34. As this happens, hydraulic pressure builds up in this system, and this is applied, via the control line 38, to the control valve 35. When this pressure reaches a predetermined level, the control valve 35 is switched from the illustrated position o (in which it prevents flow of pressurised hydraulic fluid along the line 23) into the position a, so that hydraulic fluid can flow to the valve 22 of the ram 2. Consequently, as the valve 22 is open, pressurised hydraulic fluid can pass from the highpressure line P, through the line 23 and the open control valves 35 and 36, and into the working chamber 19 of the ram 2. While the advance ram 1 is in the extended position, the hydraulic pressure is maintained in the metering chambers 6 and 17 and the line 10, so that the valve 22 remains open. Consequently, the piston rod 16 of the ram 2 moves out of the cylinder 14 to the same extent as the piston rod 5 of the advance ram 1 moves into the cylinder 3. As soon as the pressure in the metering chambers 6 and 17 (and hence also in the line 10 and the control line 38) diminishes, the control valve 35 is automatically switched into the position o by the biassing force of the spring 37, and so the supply of pressurised hydraulic fluid to the valve 22 is interrupted. The control valve 35 thus provides additional safety in the event of the valve 22 failing to operate. In such a case, the control valve 35 prevents undesirable extension of the roof bar extension associated with the ram 2.

As the ram 2 is extended, pressurised hydraulic fluid is forced out of its annular working chamber 33 and into the return line R, via the line 32, a valve device 43 and the open control valve 30. The valve device 43 is incorporated in both the lines 31 and 32, which lead to the output side of the control valve 30. The valve device 43 comprises two hydraulically-actuated, spring-loaded non-return valves 44 and 45; the valve 44 being contained in the line 32, and the valve 45 being contained in the line 31. The non-return valve 44 can be opened by the pressure of hydraulic fluid in either the hydraulic control line 38 or the line 31. Similarly, the non-return valve 45 can be opened by the pressure of hydraulic fluid in either the line 32 or a hydraulic control line 46. The control line 46 is connected to the line 26 which connects the output side of the control valve 25 to the working chamber 28 of the advance ram 1. As long as the pressure in the control line 38 holds the control valve 35 in the position a, the non-return valve 44 is also held open, so that the pressurised hydraulic fluid displaced from the ram 2 can flow away through the line 32. If the pressure in the control line 38 drops, the valve 44 closes, and so shuts off the discharge of hydraulic fluid from the annular working chamber 33 of the ram 2.

The control arrangement described above ensures that the ram 2 is extended automatically once the advance ram 1 is retracted. However, the contorl valve 30 and the lines 31 and 32 can also be used to extend or retract the ram 2 manually. For this purpose, a control device 47 is provided. The device 47 includes a mechanically-operated, spring-loaded, non-return valve 48 which is connected to the control line 38, via a line 49. The valve 48 is also connected to the line 26, via a line 49. The valve 48 is also connected to the line 26, via a line 50. The valve 48 is normally in the closed position, and it can be opened by means of a manually-operable switching member 51, for example a button, or a lever. When the switching member 51 is actuated, the valve 48 opens, so that the control line 38 communicates, via the lines 49 and 50 with the line 26 which establishes connection with the return line R in the switching position o of the control valve 25. Actuation of the switching member 51, therefore, causes the control line 38 (and the hyraulic system 6, 10 and 17 connected thereto) to be depressurised, so that the control valve 35 is switched into the position o, and the flow of pressurised hydraulic fluid along the line 23 is blocked. If the control valve 30 is then moved into the position a, communication between the high-pressure line P and the working chamber 19 of the ram 2 is established by way of the line 31, so tht the ram 2 can be extended manually. Pressurised hydraulic fluid is then discharged from the annular working chamber 33, and into the return line R via the ine 32, the open valve 44 and the control valve 30. The valve 44 is opened by the hydraulic pressure in the line 31. Similarly, by manually moving the control valve 30 to the position b, the ram 2 can be retracted by pressurised hydraulic fluid flowing to the working chamber 33 along the line 32; and the valve 45 is opened, by the hydraulic pressure in the line 32, to permit hydraulic fluid discharged from the working chamber 19 to flow to the return line R.

If the valve 48 is then closed, with the aid of the actuating member 51, the automatic synchronised control arrangement is switched in again.

The control device 47 also includes pressure-relief valves 13 as well as a pair of opposed non-return valves **52*a* and 52*b*. The non-return valves 52*a*, and 52*b* open and close in opposite directions, and are incorporated in a line 52 connecting the lines 27 and 32. During extension of the advance ram 1, the non-return valve 52*a* is hydraulically actuated by way of the line 50. Consequently, hydraulic fluid flows out of the annular working chamber 29 of the advance ram 1, along the lines and 27 and 32, and into the annular working chamber 33 of the ram 2, so that the latter is retracted in synchronism with the extension of the advance ram 1**.

It will be apparent that the movements of the advance ram 1 and the ram 2 can be synchronised in a reliable manner with the aid of the control means described above. Moreover, the arrangement may be modified in such a manner that a plurality of (for example, two) rams 2 are associated with a common advance ram 1. In this case, the metering pistons 18 of the rams 2 are actuated in the manner described, by the metering piston 7 of the common advance ram 1. The volume of the annular working chamber 29 of the advance ram 1 is equal to, or greater than, the volume of the annular working chamber(s) 33 of the associated ram(s) 2. Accordingly, the volume of the cylindrical working chamber 28 of the advance ram 2 is greater than the volume of the annular working chamber(s) 33. Furthermore, the plunger-operated valve 22 could be replaced by, for example, a magnetically-operated valve.

At least one hydraulic pivot ram may be provided for the roof bar extension associated with the ram 2, the pivot ram(s) enabling the roof bar extension to be swung upwards towards, and braced against, the roof of the working. A pivot ram of this kind is designated by the numeral 53 in FIG. 2. The ram 53 has a cylindrical working chamber 57, which is connected, via a hydraulic line 58, to the low-pressure line ND; the annular working chamber 59 of the ram 53 being connected to the return line R. A hydraulically-operated, spring-loaded, nonreturn valve 54 is provided in the line 58. The valve 54 is normally closed, and may be opened by the pressure of hydraulic fluid in a control line 55, which is connected to the line 26 leading to the working chamber 28 of the advance ram 1. A pilot-operated control valve 56 is associated with the ram 53. This valve 56 is a 3/3-way valve, whose input side is connected to the return line R and to the high-pressure line P, and whose output side communicates, via a line 60, with the line 58 downstream of the valve 54.

The arrangement is such that, during the follow-up advance movement of the roof support unit (that is to say during extension of the advance ram following pressurisation of the working chamber 28), the value 54 is opened by the pressure of hydraulic fluid in the control line 55, so that the working chamber 57 of the ram 53 is connected to the low-pressure pipe ND. The result of this is that the roof bar extension of the roof support unit remains braced against the roof of the working. The roof bar itself, however, is slightly retracted by relaxing the pressurisation of the props of the unit. Consequently, as the roof support unit is advanced, its roof bar is guided into the roof bar extension, which is braced against the roof. On completion of the follow-up advance step, and after the props of the roof support unit have been repressurised, the ram 53 can again be charged, via the pilot valve 56, with hydraulic fluid from the high-pressure line P.

The arrangement described above could be modified by replacing the pilot-operated control valve 56 by a hydraulically-operated control valve. In this case, the roof bar extension would be pressed against the roof by the ram 53, normally by a high force corresponding to the pressurised hydraulic fluid in the high-pressure line P. This high force would be reduced by connecting the working chamber 57 of the ram 53 to the low-pressure line ND, when the roof bar extension is to be extended: or, when the roof support unit is advanced, the roof bar extension is retracted.

We claim:

1. A hydraulic control arrangement comprising a first hydraulic ram, a second hydraulic ram, and an hydraulic control circuit connected with the first and second hydraulic rams, each of the hydraulic rams having a cylinder, a piston reciprocable within the cylinder, and a hollow piston rod fixed to the piston, and each of the hydraulic rams having a cylindrical working chamber and an annular working chamber positioned on opposite sides of its piston, wherein the hollow piston rod of each hydraulic ram defines a cylinder of a respective metering ram, a respective metering piston being reciprocable within the cylinder of each metering ram to define a metering chamber therewithin, wherein the hydraulic control circuit includes a line, which interconnects the two metering chambers, and a normally closed hydraulic valve positioned in a hydraulic fluid supply line leading to one of the working chambers of the second hydraulic ram, said normally closed hydraulic valve comprising a valve seat and a valve closure member normally seated on the valve seat and closing said valve, and wherein an actuator is coupled to the metering piston of the second hydraulic ram for movement therewith, said actuator being engageable with the closure member of the normally closed hydraulic valve to lift said closure member off said valve seat and open said valve in response to movement of the metering piston of the second hydraulic ram, thereby controlling the flow of hydraulic fluid to said one working chamber of said second hydraulic ram.

2. A hydraulic control arrangement according to claim 1, further comprising a high-pressure hydraulic fluid supply line and a hydraulic return line, the high-pressure line and the return line being connected to the working chambers of the first and second hydraulic rams by the hydraulic control circuit.

3. A hydraulic control arrangement according to claim 2, wherein the metering piston of the first hydraulic ram extends through the piston of that ram, and is fixed to the internal end wall of the cylinder of that ram.

4. A hydraulic control arrangement according to claim 2, wherein the hydraulic valve is positioned in the end wall of the cylinder of the second hydraulic ram that defines part of said one working chamber.

5. A hydraulic control arrangement according to claim 4, wherein the hydraulic valve is a mechanically-actuated, spring-loaded, non-return valve.

6. A hydraulic control arrangement according to claim 1, wherein the two metering chambers have the same cross-sectional area.

7. A hydraulic control arrangement according to claim 4, wherein the metering piston of the second hydraulic ram extends through the piston of the second hydraulic ram, said metering piston being movable relative to both the piston rod and the cylinder of the second hydraulic ram, and wherein said metering piston controls the hydraulic valve indirectly by means of an actuating member.

8. A hydraulic control arrangement according to claim 7, wherein the actuating member is a rod which is slidably mounted in a bore in said end wall of the cylinder of the second hydraulic ram.

9. A hydraulic control arrangement according to claim 2, wherein the line which interconnects the two metering chambers is connected to the return line by a hydraulic line which incorporates a non-return valve.

10. A hydraulic control arrangement according to claim 1, wherein the metering chambers are protected by pressure-relief valves.

11. A hydraulic control arrangement according to claim 2, wherein a first hydraulic control valve is arranged in the hydraulic fluid supply line upstream of the hydraulic valve, the first hydraulic control valve being arranged to control the flow of hydraulic fluid from the high-pressure line along the hydraulic fluid supply line to the hydraulic valve, and being opened and closed in dependence upon the pressure of the hydraulic fluid in the metering chamber of the second hydraulic ram.

12. A hydraulic control arrangement according to claim 11, wherein the first hydraulic control valve is a hydraulically-controlled valve which has a hydraulic control line connected to the line which interconnects the two metering chambers.

13. A hydraulic control arrangement according to claim 11, wherein a second hydraulic control valve is arranged in the hydraulic fluid supply line, the second hydraulic control valve being a mechanically-operated control valve, and being effective to open and close the hydraulic fluid supply line to the flow of hydraulic fluid from the high-pressure line.

14. A hydraulic control arrangement according to claim 12, further comprising a manually-actuated hydraulic control valve for controlling the extension and retraction of the second hydraulic ram.

15. A hydraulic control arrangement according to claim 14, wherein the manually-actuated hydraulic control valve controls the flow of hydraulic fluid between the high-pressure and return lines and hydraulic lines leading to the two working chambers of the second hydraulic ram.

16. A hydraulic control arrangement according to claim 14, further comprising a control device for controlling the first hydraulic control valve.

17. A hydraulic control arrangement according to claim 16, wherein the control device includes a non-return valve which is connected to the line which interconnects the two metering chambers so that, when said non-return valve is open, the line interconnecting the two metering chambers (and hance the hydraulic control line associated with the first hydraulic control valve) is connected to the return line, whereby the first hydraulic control valve is closed to block the flow of hydraulic fluid from the high-pressure line along the hydraulic fluid supply line.

18. A hydraulic control arrangement according to claim 16, wherein the control device is provided with a manually-actuated switching member by means of which the control device is actuated.

19. A hydraulic control arrangement according to claim 14, wherein the hydraulic lines connecting the working chambers of the second hydraulic ram to the manually-actuated hydraulic control valve include respective hydraulically-operated non-return valves.

20. A hydraulic control arrangement according to claim 1, wherein the volume of the annular working chamber of the first hydraulic ram is at least equal to the volume of the annular working chamber of the second hydraulic ram.

21. A hydraulic control arrangement according to claim 2, further comprising a third hydraulic ram, the third hydraulic ram having cylindrical and annular working chambers which are pressurisable in dependence upon the pressurisation of one of the working chambers of the first hydraulic ram.

22. A hydraulic control arrangement according to claim 21, further comprising a low presure hydraulic fluid supply line, the cylindrical working chamber of the third hydraulic ram being connected to the low-pressure line via a hydraulic line which includes a hydraulically-actuated control valve, said control valve being provided with a hydraulic control line which is connected to the cylindrical working chamber of the first hydraulic ram.

23. A hydraulic control arrangement according to claim 22, wherein the cylindrical working chamber of the third hydraulic ram is connected to the high-pressure line via a hydraulic line containing a pilot-operated control valve.

24. A hydraulic control arrangement according to claim 23, wherein the pilot-operated control valve is a 3/3-way control valve whose input side is connected to the high-pressure line and to the return line.

25. A hydraulic ram comprising a cylinder, a piston reciprocable within the cylinder, and a hollow piston rod fixed to the piston, the hydraulic ram having a cylindrical working chamber and an annular working chamber positioned on opposite sides of the piston, and the hollow piston rod defining a cylinder of a metering ram, a metering piston being reciprocable within the cylinder of the metering ram to define a metering chamber therewithin, wherein a normally closed hydraulic valve is positioned in the end wall of the ram cylinder that defines part of the cylindrical working chamber, said normally closed hydraulic valve comprising a valve seat and a valve closure member normally seated on said valve seat and closing said valve, and an actuator coupled to said metering piston for movement therewith, said actuator being engageable with the closure member of the normally closed hydraulic valve to lift said closure member away from the valve seat and to open said normally closed hydraulic valve in response to movement of the metering piston, thereby controlling the supply of pressurized hydraulic fluid to the cylindrical working chamber, whereby, the hydraulic valve is actuated by movement of the metering piston toward said end wall.

* * * * *